United States Patent [19]

Sano et al.

[11] Patent Number: 4,663,874

[45] Date of Patent: May 12, 1987

[54] MAGNETICALLY ATTACHABLE SIGN

[75] Inventors: Shigeo Sano, Saitama; Masato Komatsuzaki, Kanagawa, both of Japan

[73] Assignee: C. I. Kaseo Co., Ltd., Tokyo, Japan

[21] Appl. No.: 684,825

[22] Filed: Dec. 21, 1984

[30] Foreign Application Priority Data

Feb. 24, 1984 [JP] Japan ..... 59-24579[U]

[51] Int. Cl.[4] ..... G09F 7/04

[52] U.S. Cl. ..... 40/621; 40/600; 52/DIG. 4; 428/900

[58] Field of Search ..... 40/600, 621, 449, 594, 40/595, 618, 611, 10 R; 428/900; 273/239; 52/DIG. 4; 148/100, 31.55, 31.57, 111

[56] References Cited

U.S. PATENT DOCUMENTS

| | | | |
|---|---|---|---|
| 2,599,047 | 6/1952 | Clark | 428/900 |
| 3,102,314 | 9/1963 | Alderfer | 40/621 |
| 3,126,924 | 3/1964 | Kirkpatrick | 428/900 |
| 3,256,442 | 6/1966 | Sedlak | 52/DIG. 4 |
| 3,817,785 | 6/1974 | Abitboul | 428/900 |
| 3,839,130 | 10/1974 | Dean et al. | 428/900 |
| 3,942,147 | 3/1976 | Josephson | 40/621 |
| 4,197,151 | 4/1980 | Muzik | 40/600 |
| 4,258,920 | 3/1981 | Waldron et al. | 428/900 |
| 4,300,260 | 11/1981 | Hill | 428/900 |
| 4,457,723 | 7/1984 | Tate | 428/900 |

FOREIGN PATENT DOCUMENTS

| | | | |
|---|---|---|---|
| 1957876 | 5/1971 | Fed. Rep. of Germany | 40/621 |
| 968487 | 9/1964 | United Kingdom | 40/621 |
| 1367079 | 9/1974 | United Kingdom | 40/621 |

*Primary Examiner*—Gene Mancene
*Assistant Examiner*—J. Hakomaki
*Attorney, Agent, or Firm*—Sughrue, Mion, Zinn Macpeak & Seas

[57] ABSTRACT

A flexible magnetic sign, such as may be detachably provided on a body panel of a motor vehicle, in which bulging due to the presence of air or moisture is eliminated. The rear surface of the sign is formed with trough-indentations. This may take the form of parallel stripes, a checkered pattern, indentations having a random orientation, or a textured surface.

9 Claims, 5 Drawing Figures

MAGNETICALLY ATTACHABLE SIGN

BACKGROUND OF THE INVENTION

The present invention relates to a magnetic sheet, specifically, a magnetic sheet which may be used as a sign and which is attachable to a metal surface. For instance, such a sign may be used as an advertising or identifying sticker attached to the body of a motor vehicle.

FIG. 1 is a perspective view showing a conventional sign of this type. The sign 1, which is composed of a flexible magnetic sheet which may carry advertising or the like, is detachably magnetically applied to a body panel 2 of a vehicle. Upon being exposed to the atmosphere, circular bulges 3 in bubble form having a diameter of typically anywhere from 2 mm to 10 cm tend to appear. The formation of the bulges 3 is due to the presence of air or water which has been sealed between the rear side of the sign and the body panel 2, which air or water is expanded when the sign 1 is heated by sunlight.

SUMMARY OF THE INVENTION

It is a primary object of the present invention to provide a magnetically attachable and detachable sign which has no bulges as in the case of the conventional sign described above.

It has been customary in the case of the conventional sign for its surface in contact with the body panel to be as smooth as possible. In contrast, the sign of the invention is characterized by a flexible magnetic sheet which is provided on its rear surface with indentations defined by ridges or grooves in the form of stripes or in a checkered pattern, or by a scratched or textured surface, thereby to allow air or moisture to escape.

DESCRIPTION OF THE PREFERRED EMBODIMENTS

Figure 1:
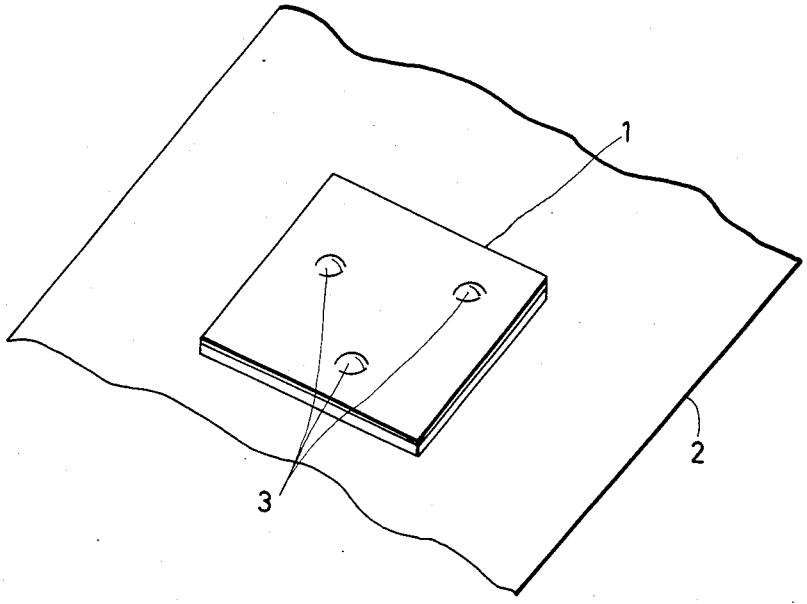
FIG. 1 PRIOR ART
FIG. 1 is a perspective view showing a conventional magnetic sign of the same general type to which the invention pertains.
Figure 2A:
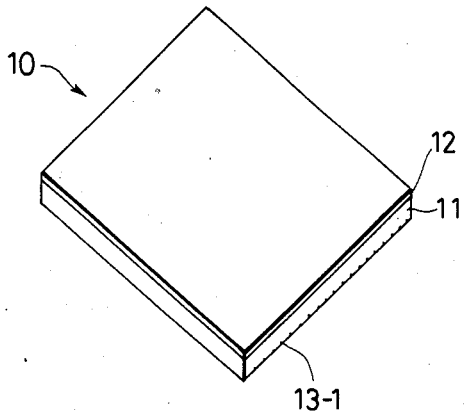
FIGS. 2A and 2B are front and rear perspective views, respectively, of a magnetic sign constructed in accordance with a first embodiment of the invention.
Figure 2B:
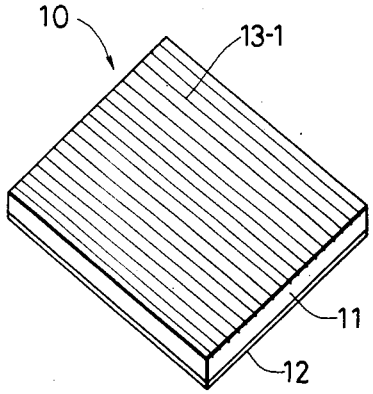

Referring now to FIGS. 2A and 2B, a first embodiment of a magnetically attachable and detachable magnetic sign embodying the invention will be described. FIG. 2A is a perspective view showing the sign from the front surface, and FIG. 2B is a perspective view showing the sign from the rear surface.

The sign 10 is composed of a flexible magnetic sheet 11 having a front surface layer 12 which carries an advertising phrase or the like. The sheet 11 is provided on its rear surface with parallel stripes in the form of indentations 13-1 extending from end to end.

The magnetic sheet 11 is composed of a particulate ferromagnetic body formed of a metallic oxide such as barium ferrite or the like and a mixture of rubber or plastic containing small quantities of compounds such as plasticizers, stabilizers, or the like. The magnetic sheet

11 may be manufactured using well-known techniques such as calendering, extruding or stamping. The thickness of the magnet sheet 11 is not particularly limited and, for example, can be in a range of 0.3 to 2.0 mm. The rear surface of the sheet 11 is magnetized using a multiple-electrode magnetizer, again according to a well-known technique. The front surface 12 which carries advertising or the like can be printed or painted as desired.

The indentations 13-1 may be in the form of serrations, or they may have the form of convex or concave cross sections or the like. The depth of the indentations 13-1 is preferably in a range of 3 to 100 microns, more preferably, in a range of 5 to 40 microns. The magnetizing force is considerably lowered if the depth of the indentations 13-1 is greater than 100 microns. In general, the thickness of the sheet 11 should be increased by the depth of the indentations 13-1.

The spacing between the indentations 13-1, also referred to as the "pitch", is related to the width and depth thereof. Preferably, the indentations 13-1 are spaced by 1 mm or less. If the spacing is greater than 5 or 6 mm, it has been found that bulging is not adequately reduced.

The indentations 13-1 may be formed by any of the following three processes:

(1) After embossing process: The sheet 11 is embossed at a temperature above the softening temperature of its material using an embossing roll or a stamping panel in which a plurality of protrusions are formed by cutting (or sand blasting in the case of the texture surface which will be described in conjunction with FIG. 3A below).

(2) Simultaneous forming process: The sheet 11 is formed with an indented surface during its own formation with the use of a calendering roll, extrusion dye or stamping panel having a plurality of protrusions formed therein.

(3) Cutting process: A plurality of indentations 13-1 are formed by cutting or scratching the rear surface of the sheet 11.

From the viewpoint of productivity, easy workability and reduced cost, it is preferable to use the after embossing process whereby the indentations 13-11 are formed by a calendering roll. The simultaneous forming process is also economical. The after embossing process is advantageous in that the depth of the indentations 13-1 can easily be varied.

Figure 3A:
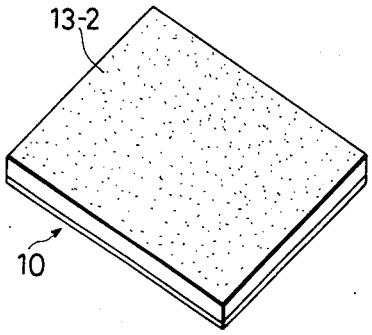
FIGS. 3A and 3B are perspective views of the rear surfaces of respective second and third embodiments of a magnetic sign constructed in accordance with the present invention.
Figure 3B:
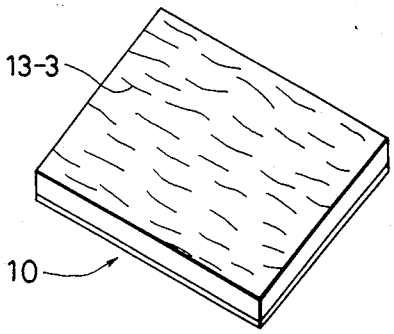

FIGS. 3A and 3B are perspective views showing the rear surfaces of magnetic signs constructed in accordance with second and third embodiments of the invention. The rear surface 13-2 of the sign 10 in the embodiment of FIG. 3-A is textured, having randomly distributed ridges and troughs. The depth of the troughs is preferably on the order of 1 to 2 microns.

In the embodiment of FIG. 3B, an indented surface 13-3 is formed by relatively short troughs which do not extend to the sides and which have the form of scratches.

In all of the three embodiments of a magnetic sign 10 described above, after the sign 10 has been magnetically applied to a body panel of a vehicle or the like, if air or moisture is trapped between the sign 10 and the body panel, the air or moisture can escape through the indented portions of the rear surface of the sign or diffuse evenly behind the sign, thereby eliminating the possibility of bulging (bubble formation) which is generated in the case of the conventional sign.

The invention will be further described with reference to test results presented in Tables 1 and 2 below. Tables 1 and 2 show results of test conducted with four samples A through D of magnetic signs, each having a thickness of 0.7 mm, a length of 20 cm, and a height of 20 cm. Each of these was allowed to magnetically adhere to a painted surface similar to a body panel of an automotive vehicle and then left in an oven at a temperature of 80° C. for varying periods of time. Table 1 shows the test results of a dry painted surface, whereas Table 2 shows test results when the same was wetted with water.

TABLE 1

| | (dry painted) | | | | | |
|---|---|---|---|---|---|---|
| | Time | | | | | |
| Sample | 30 min. | 1 hr. | 2 hrs. | 5 hrs. | 10 hrs. | 24 hrs. |
| A | o | x | x | x | x | x |
| B | o | o | o | o | o | o |
| C | o | o | o | o | o | o |
| $D_1$ | o | o | o | o | o | o |
| $D_2$ | o | o | o | o | o | o |
| $D_3$ | o | o | o | o | o | o |

TABLE 2

| | (painted surface wetted with water) | | | | | |
|---|---|---|---|---|---|---|
| | Time | | | | | |
| Sample | 30 min. | 1 hr. | 2 hrs. | 5 hrs. | 10 hrs. | 24 hrs. |
| A | x | x | x | x | x | x |
| B | x | x | x | x | x | x |
| C | o | x | x | x | x | x |
| $D_1$ | o | o | o | o | o | o |
| $D_2$ | o | o | o | o | o | o |
| $D_3$ | o | o | o | o | o | o |

o — no bulge
x — bulged
A: flat magnet sheet (conventional sticker)
B: magnetic sheet having textured surface (FIG. 3A)
C: magnetic sheet having scratches having a depth of 2 to 3 microns (FIG. 3B)
$D_1$: magnetic sheet having indented surface with stripes having a depth of 5 microns with a constant pitch of 100 microns (FIG. 2B)
$D_2$: magnetic surface having indented surface in the same form as in $D_1$ but having a depth of 40 microns with a constant pitch of 50 microns (FIG. 2B)
$D_3$: magnetic sheet having indented surface in the same form as in $D_1$ but having a depth of 60 microns with a constant pitch of 100 microns (FIG. 2B)

As can readily be understood from these test results, when applied to a dry painted surface, the amount of bulging with the magnetic signs of the invention is reduced to a considerable extent when compared with the conventional case. Particularly, it is noted that, even in the case where the surface is wet as in Table 2, the magnetic sign of the first embodiment (FIGS. 2A and 2B) is greatly advantageous compared with the prior art sign.

As described above, the magnetic sign according to the invention is considerably effective in eliminating the bulges which would otherwise be generated. A still further advantage is that there is less marking of the body panel of the vehicle when the sign is used over long periods of time.

This completes the description of the preferred embodiments of the invention. Although preferred embodiments have been described, it is believed that numerous modifications and alterations thereto would be apparent to one having ordinary skill in the art without departing from the spirit and scope of the invention.

We claim:

1. A flexible magnetic outdoor sign comprising a flexible magnetic non-fabric solid particulate sheet formed of a mixture of ferromagnetic particles and rubber or plastics and carrying on an outer continuous surface thereof an advertising message or the like and having a rear surface magnetically attachable to a metal surface, said rear surface of said magnetic sign being provided with a plurality of indentation means, at least some of which extend to at least one edge of said rear surface, for allowing air and moisture to escape from between said rear surface and said metal surface, thereby eliminating bulging of the sign.

2. The flexible magnetic sign of claim 1, wherein said metal surface is the surface of an automobile, and said indentation means are in the form of a plurality of parallel troughs extending from one edge of said rear surface to an opposite parallel edge thereof.

3. The flexible magnetic sign of claim 1, wherein said indentation means comprise a plurality of short troughs having a length less than a width or height of said sign.

4. The flexible magnetic sign of claim 1, wherein said indentation means comprise indentations in the form of a textured surface.

5. The flexible magnetic sign of claim 1, wherein said indentation means comprise indentations having a depth in a range of 3 to 100 microns.

6. The flexible magnetic sign of claim 1, wherein said indentation means comprise indentations having a depth in a range of 5 to 40 microns.

7. The flexible magnetic sign of claim 4, wherein a depth of indentations of said textured surface is of the order of 1 to 2 microns.

8. A flexible magnetic outdoor sign comprising a flexible magnetic non-fabric solid particulate sheet formed of a mixture of ferromagnetic particles and rubber or plastics and carrying on an outer continuous surface thereof an advertising message or the like and having a rear surface magnetically attachable to a metal surface, said rear surface of said magnetic sign being provided with a plurality of indentation means, which extend to at least one edge of said rear surface, for allowing air and moisture to escape from between said rear surface and said metal surface, thereby eliminating bulging of the sign;

wherein said indentation means comprise a plurality of indentations having a pitch of 1 mm or less.

9. A flexible magnetic outdoor sign comprising a flexible magnetic non-fabric solid particulate sheet formed of a mixture of ferromagnetic particles and rubber or plastics and carrying on an outer continuous surface thereof an advertising message or the like and having a rear surface magnetically attachable to a metal surface, said rear surface of said magnetic sign being provided with a plurality of indentation means, which extend to at least one edge of said rear surface, for allowing air and moisture to escape from between said rear surface and said metal surface, thereby eliminating bulging of the sign;

wherein said indentation means comprise a plurality of indentations having a depth in a range of 3 to 100 microns and a pitch of 1 mm or less.

* * * * *